United States Patent [19]

Stevens

[11] Patent Number: 4,819,276

[45] Date of Patent: Apr. 11, 1989

[54] GERMICIDAL TOILET SEAT

[76] Inventor: Robert B. Stevens, P.O. Box 26284, Honolulu, Hi. 96825

[21] Appl. No.: 30,374

[22] Filed: Mar. 26, 1987

[51] Int. Cl.[4] ..... A47K 9/02

[52] U.S. Cl. ..... 4/233; 4/236

[58] Field of Search ..... 4/222, 233, 234, 237, 4/661, 236, 240; 362/131, 154, 802, 96

[56] References Cited

U.S. PATENT DOCUMENTS

| | | | |
|---|---|---|---|
| 2,273,449 | 2/1942 | Plishker | 4/233 |
| 2,332,111 | 10/1943 | Porter et al. | 4/233 |
| 2,458,019 | 1/1949 | Niles | 4/233 |
| 2,744,264 | 5/1956 | Sperzel | 4/240 |
| 2,814,048 | 11/1957 | Reinhard | 4/240 |
| 4,449,167 | 5/1984 | Cohen | 362/802 |

*Primary Examiner*—Henry J. Recla
*Assistant Examiner*—Linda J. Sholl

[57] ABSTRACT

A toilet seat and lid combination, of generally customary shape and dimension, self-disinfected by means of germicidal U.V. light, and its by-product Ozone, generated by a tubular lamp, housed within a module, and mounted in the rear of the toilet seat lid proximal to and parallel with the axis of rotation of the toilet seat and lid. The electrical wires for the lamp are concealed within a conduit that runs through an attachment shank. Motion of the toilet seat and lid are dampened by means of detachable flat springs and a bias force under the toilet surface that communicates through a shank used to mount the toilet seat and lid to a toilet.

1 Claim, 2 Drawing Sheets

GERMICIDAL TOILET SEAT

BACKGROUND OF THE INVENTION

Field of Invention.

This invention relates to the disinfection or sterilization of the toilet seat and proximal areas of the toilet seat by means of germicidal ultraviolet radiation, and its by-product ozone, which are produced by a tubular lamp mounted in the rear of the toilet seat lid parallel with the axis of rotation of the toilet seat and lid.

A search of U.S. Patents reveals a variety of self-disinfecting toilet seat concepts. For example, in U.S. Pat. No. 4,183,105 to Womak, a solution is sprayed inside the toilet. In U.S. Pat. No. 4,063,316 to Hunninghaus, fluids are passed over the toilet seat. In U.S. Pat. Nos. 4,193,144 and 3,801,999 to McNally, a liquid material is conveyed through a seat permeable to the liquid. In U.S. Pat. No. 3,837,018 to Haberie, an apparatus equipped with brushes sanitizes the surface of a toilet seat.

Disinfection by ultraviolet light has been applied to toilet seats. U.S. Pat. Nos. 2,253,736 to R. L. Sullivan, 2,281,265 to H. S. Campbell, 2,440,231 and 2,440,232 to L. H. Davidson, 2,525,492 to H. B. Leidy, 2,536,095 to K. Beyrodt, and 2,592,167 to J. Managhan all use ultraviolet light by means of a lamp within a housing or cabinet that accepts a toilet seat and acts as a shield of the ultraviolet light. In U.S. Pat. No. 2,460,543 to E. Spierer a circular shaped lamp is placed in a cut-out around the underneath of a toilet seat. In U.S. Pat. No. 2,458,019 to Niles a germicidal lamp is housed within a box-like structure shaped into the form of a toilet seat. In these last two inventions lies a major problem that no moulding material is available, even today, that permits the transmission of germicidal ultraviolet light or is structurally able to support the intended loads.

Toilet seat lifting, biasing and dampening mechanisms are shown in the prior art. In U.S. Pat. No. 3,414,911 to D. T. Enlow a coil spring is used to bias a toilet seat. In U.S. Pat. No. 4,426,743 to A. B. Seabrooke a toilet seat is elevated by a foot pedal, cable and crank. In both self-disinfecting and non-disinfecting toilet seat designs there are a variety of lifting mechanisms.

In summary, I can find no prior art that has the concept, features or design of my germicidal toilet seat. By housing the germicidal lamp in the rear of the toilet seat along the axis of rotation the problems of inertial force are virtually eliminated. Also, the compact modular unit and fully concealed electrical conduit makes the unit tamper-proof and easily serviced. By design, the toilet seat and lid are hardly recognizable as being self-disinfecting. The narrow angle of light generation and small angle of incidence are overcome by the mechanism of reflection in relation to the light scatter. A 6-Watt germicidal lamp, as depicted in the preferred embodiment, will generate over the surfaces about 100 microwatt-seconds per sq.cm of 253.7 nm germicidal light. This dose will kill 99% of subject pathogenic micro-organisms including Herpes Simplex Virus (HSV), *E. coli, Shigella flexneri, Staph. aureas, Strep. pyogenes* and many others in less than one minute; as little as 6 seconds for some HSV strains that normally take many hours to die without germicidal application. Although the toilet seat and lid weigh comparable to non-germicidal designs two motion dampening mechanisms, one being a pair of detachable flat springs and the other a biased force wire communicating through an attachment shank, provide the toilet seat and lid a smooth motion even though the germicidal lamp and apparatus are virtually indestructable under the most violent possible use. This timely invention is truly intended and designed for the environment of its application. It is highly effective in destroying pathogenic micro-organisms, is completely safe to use, aesthetic, and is highly efficient (costs about 25¢ a month).

SUMMARY OF THE INVENTION

An object of the invention is disinfection or sterilization of a toilet seat, toilet bowl and underside of the toilet lid by means of germicidal ultraviolet radiation.

A further object of the invention is deodorization and disinfection of a toilet seat and its proximal areas by means of ozone which is produced by a lower frequency of ultraviolet spectra.

A further object of the invention is a modular unit comprising the germicidal lamp and other components.

A further object of the invention is an automatic switch that shuts off the unit during use.

A further object of the invention is an electrical wiring conduit within the shanks and hinging assembly mechanism of the toilet seat and lid.

A further object of the invention is controlled motion of the toilet lid and/or toilet seat so that the ultraviolet emitting lamp and components are protected against rough handling.

A further object of the invention is placement of motion controlling devices under the surface of the toilet seat with means of communicating with the toilet seat or lid through the shank used to mount the seat to the toilet.

A further object of the invention is water and impact resistance of the germicidal unit.

A further object of the invention is a toilet seat and lid fixture that is normal and streamline in use and appearance.

Other objects and advantages of the invention will become apparent from the following description.

BRIEF DESCRIPTION OF THE DRAWING

In order that the invention may be more readily understood, reference will now be made to the accompanying drawings which show one embodiment thereof by way of example and in which.

DESCRIPTION OF THE PREFERRED EMBODIMENT

Before explaining the present invention in detail it is to be understood that the invention is not limited in its application to the details of construction and arrangement of parts illustrated in the accompanying drawing, since the invention is capable of other embodiments and of being practiced or carried out in various ways. Also, it is to be understood that the phraseology or terminology employed herein is for the purpose of description and not of limitation.

Figure 1:
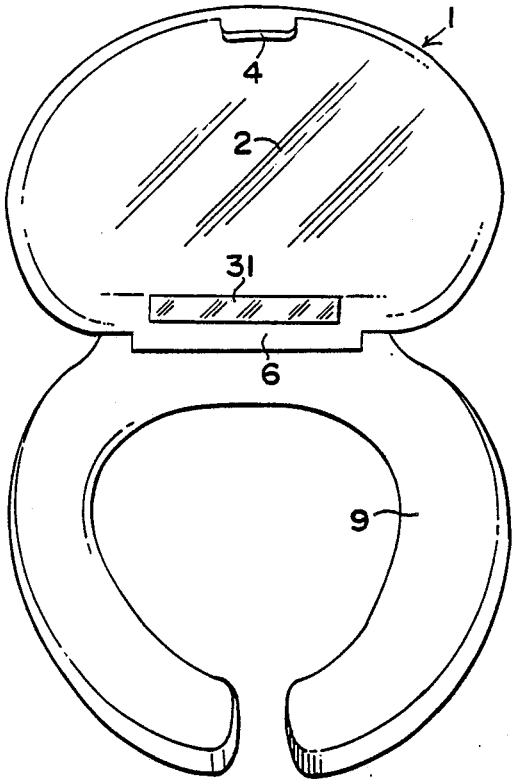
FIG. 1 is a front-top elevation view of a partially opened toilet seat and lid combination.
Figure 2:
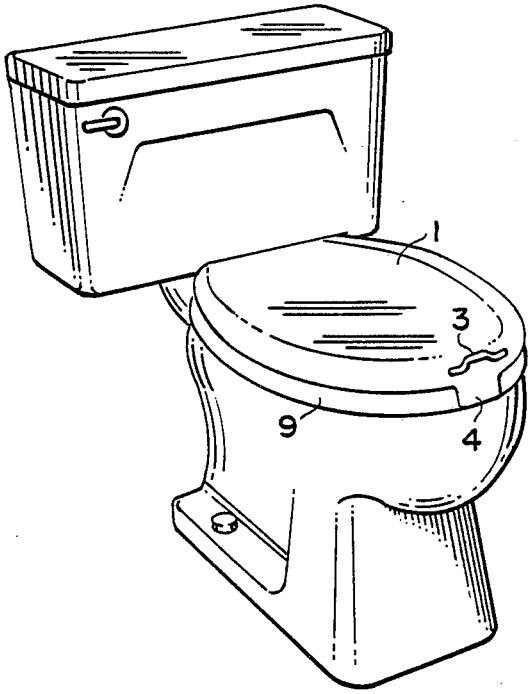
FIG. 2 is a left-front perspective view shown in relation to a toilet.
Figure 3:
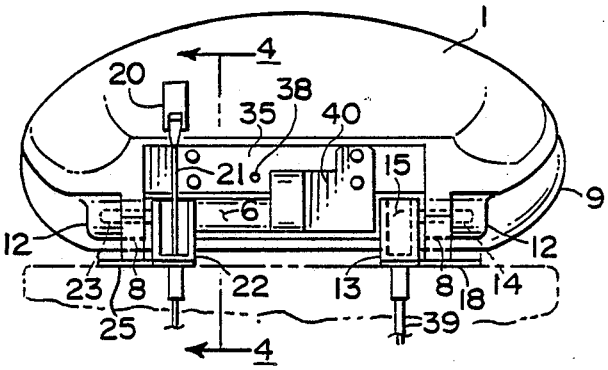
FIG. 3 is a rear elevation view.
Figure 4:
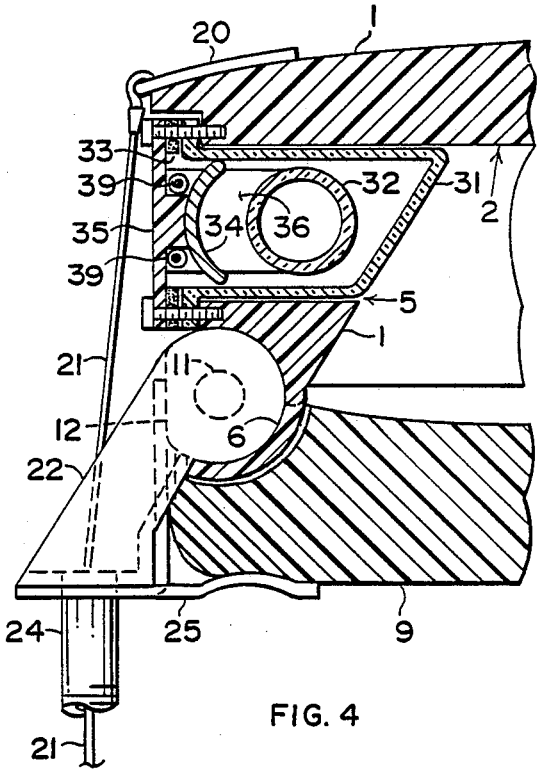
FIG. 4 is a fragmentary left side sectional view taken along line 4—4 of FIG. 3.
Figure 5:
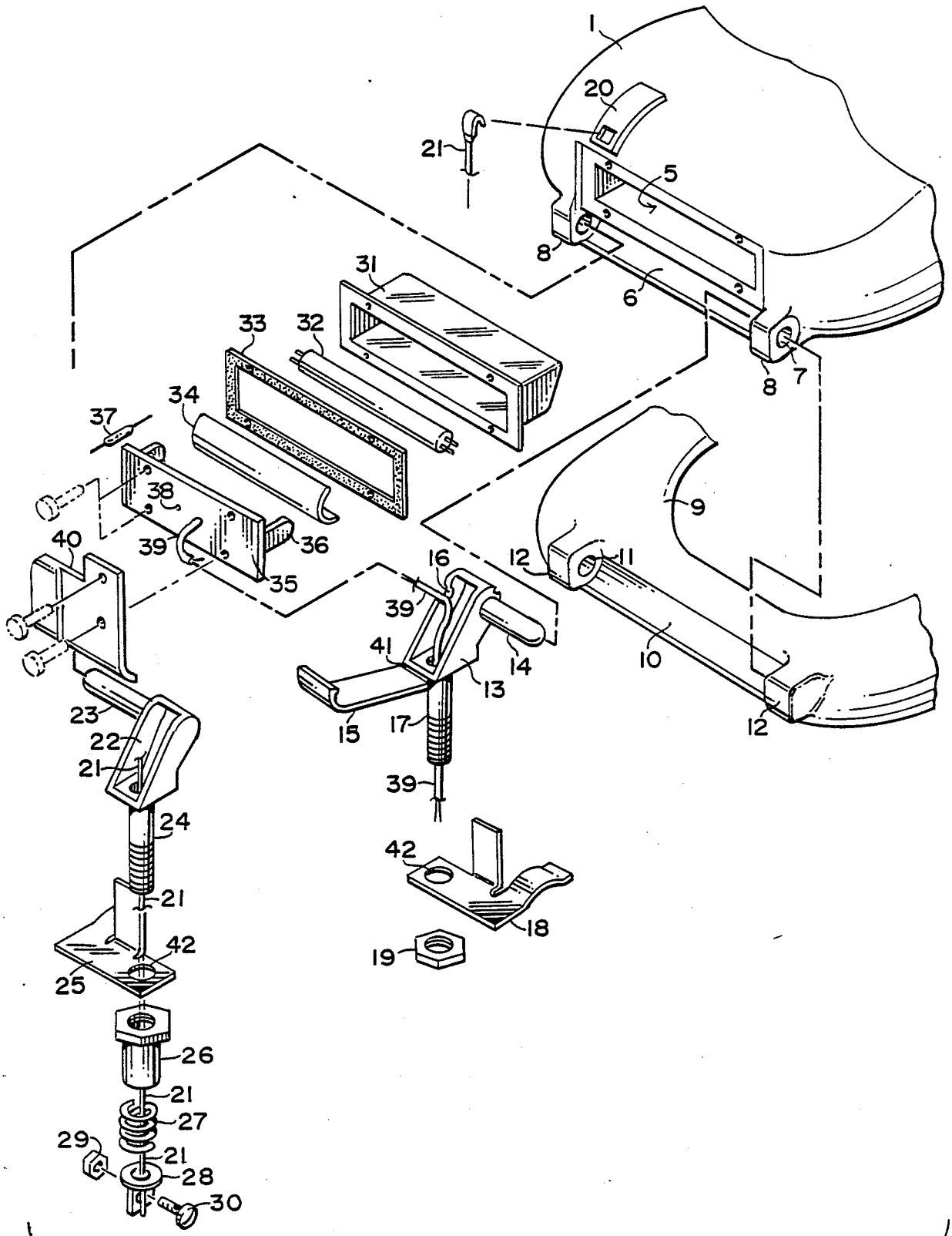
FIG. 5 is an exploded perspective view taken from the left-rear.

Referring now to the drawings wherein like reference numerals refer to like and corresponding parts throughout the several views, the preferred embodiment of the invention is disclosed in FIGS. 1 through 5 inclusive.

The invention includes a seat 9 and lid 1 combination hinged at the rear to provide pivotal movement to raised or lowered positions about an axis of rotation formed by the axis rods 14 & 23 that the toilet seat hinge bearing 12, and the lid hinge bearing 8, are free to rotate about due to their hollow axes, 11 & 7, respectively.

On the front of the lid 1 is a handle 3 and a light shield 4 which reflects U.V. light back towards the toilet seat 9 courtesy opening. In the rear of the lid 1 is a module support opening 5 that is proximal to and runs parallel with the axis of rotation, wherein said module support opening accepts the module, which is an assembly of parts, comprising: the glass capsule 31, germicidal lamp 32, gasket 33, reflector 34, and module plate 35; wherein said module plate supports the lamp holders 36, tilt switch 37, pressure equalizing duct 38 and electrical power-control wires 39. The glass capsule 31 is made of quartz or other suitable glass material that will permit the transmittance of germicidal U.V. light at or about 253.7 nm.

The electrical power-control wires 39 are protected and concealed between the module plate 35 and the electrical wire foramina 16 of the electrical conduit shank top 13 by means of an electrical wire shield 40 that encases the electrical wires 39 in the concave indentation formed by the courtesy shield 6; the center of curvature of which forms an imaginary line parallel with and essentially at the axis of rotation. The electrical power-control wires 39 are concealed where they enter the electrical conduit shank top 13, at the electrical wire foramina 16, to the hollow electrical conduit shank 17 by means of a cover shield 15 which is permanently attached to the electrical conduit shank top 13 at its lowermost edge 41; said edge being of a thin layer to permit some rotational movement of the cover shield 15, shown detached in the drawing. By virtue of the cover shield's 15 hooked upper edge it will 'snap' onto the electrical conduit shank top 13. The electrical power-control wires 39 continue through the electrical conduit shank 17 to the underneath of the surface of the toilet where the electrical conduit shank 17 is secured by the shank nut 19.

In order to control and dampen the motion of the toilet seat 9 a pair of flat springs 18 & 25, which are mirror images of each other, act to limit the upward or downward motion of the toilet seat. The flat springs 18 & 25 are attached between the conduit shank tops 13 & 22 and the toilet surface by means of a collar 42 which fits around the shanks 17 & 24.

In order to control and dampen the downward motion of the toilet lid 1 a biasing force attachment plate 20, attached to the toilet lid 1, is acted upon by a hook and tension wire assembly 21 in which the wire runs down through the counterbalancing conduit shank top 22, and inside its hollow shank 24, past and through the shank nut and spring holder 26, which holds inside it the spring 27, through and inside the spring 27 and hollow spring plate 28 and through the hole in the wire tensioning bolt 30; which crimps on the tension wire 21 by means of a nut 29 that it mates with passing through an attachment slot in the hollow spring plate 28.

The inside surface 2 of the toilet lid 1 is made of or coated with a highly reflective metallic coating such as aluminium or chromium thus enhancing the scatter effect of the U.V. light. Using modern semi-conductor technology, a seat of this design could be operated on very low currents such as those generated by rechargable flashlight batteries or low voltage permanent supplies. A tilt switch 37 precludes the necessity for remote on-off switches. The germicidal lamp 32, being housed in a module that renders it 'environmental proof', with its center of axis being proximal to and parallel with the axis of rotation making it virtually shockproof, precludes the need for motion control or dampening devices.

I claim as my invention:

1. A toilet seat and lid combination hinged in the rear to provide for pivotal movement to raised or lowered positions about an axis of rotation, said lid having an opening in the rear that accepts a tubular germicidal ultraviolet lamp such that the germicidal lamp is proximal to the axis of rotation and wherein the germicidal lamp's center of axis is generally parallel with the axis of rotation, wherein the tubular germicidal lamp is encased in a module, said module being comprised of a germicidal ultraviolet light transparent glass capsule and a module plate, wherein the module plate provides a means for holding: the germicidal lamp, the electrical power-control wires that attach to the germicidal lamp, a ultraviolet light reflector, a tilt switch which automatically interrupts the electrical current to the germicidal lamp when the lid is raised, and a means for preventing damage due to pressure-temperature increases; and wherein the opening in the rear of the lid supports the module.

* * * * *